US009510720B2

(12) United States Patent
Jang

(10) Patent No.: US 9,510,720 B2
(45) Date of Patent: Dec. 6, 2016

(54) AUTOMATIC CLEANER

(71) Applicant: Jaewon Jang, Seoul (KR)

(72) Inventor: Jaewon Jang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 794 days.

(21) Appl. No.: 13/861,182

(22) Filed: Apr. 11, 2013

(65) Prior Publication Data

US 2014/0109338 A1 Apr. 24, 2014

(30) Foreign Application Priority Data

Oct. 18, 2012 (KR) ..... 1020120115950

(51) Int. Cl.

| | |
|---|---|
| ***A47L 9/28*** | (2006.01) |
| ***A47L 11/40*** | (2006.01) |
| *A47L 9/06* | (2006.01) |
| *A47L 9/04* | (2006.01) |

(52) U.S. Cl.

CPC ..... *A47L 11/4066* (2013.01); *A47L 9/04* (2013.01); *A47L 11/4069* (2013.01); *A47L 9/0488* (2013.01); *A47L 9/064* (2013.01); *A47L 9/0633* (2013.01); *A47L 9/0646* (2013.01); *A47L 9/0653* (2013.01); *A47L 2201/00* (2013.01)

(58) Field of Classification Search

CPC ..... A47L 9/0633; A47L 9/064; A47L 9/0646; A47L 9/0653; A47L 9/0488; A47L 11/4066; A47L 11/4069; A47L 9/04; A47L 2201/00; A47L 2201/06

USPC ..... 15/319

IPC ..... A47L 9/28

See application file for complete search history.

(56) References Cited

U.S. PATENT DOCUMENTS

| | | | | |
|---|---|---|---|---|
| 7,610,651 | B2 * | 11/2009 | Baek | A47L 5/14 15/345 |
| 8,806,711 | B2 * | 8/2014 | Jang | A47L 9/009 15/319 |
| 2005/0166355 | A1 * | 8/2005 | Tani | A47L 9/2805 15/319 |
| 2006/0010638 | A1 * | 1/2006 | Shimizu | A47L 9/009 15/319 |
| 2006/0021168 | A1 * | 2/2006 | Nishikawa | A47L 9/009 15/49.1 |

FOREIGN PATENT DOCUMENTS

| | | | |
|---|---|---|---|
| JP | 62-292124 | A | 12/1987 |
| JP | 2011-045694 | A | 3/2011 |

* cited by examiner

*Primary Examiner* — David Redding

(74) *Attorney, Agent, or Firm* — Dentons US LLP

(57) ABSTRACT

An automatic cleaner includes a casing having a suction port, a suction device disposed in the casing to suction foreign substances through the suction port, a moving device that moves the casing, and a side brush assembly movably installed on the casing. The side brush assembly includes a movable member movably disposed on the casing, a first driving device that generates power for moving the movable member, a brush rotatably mounted on the movable member, and a second driving device that generates power for rotating the brush.

18 Claims, 8 Drawing Sheets

AUTOMATIC CLEANER

CROSS-REFERENCE TO RELATED APPLICATIONS

The present application claims priority under 35 U.S.C. 119 and 35 U.S.C. 365 to Korean Patent Application No. 10-2012-0115950 (filed on Oct. 18, 2012), which is hereby incorporated by reference in its entirety.

BACKGROUND

The present disclosure relates to an automatic cleaner.

In general, cleaners are home appliances which suction and remove foreign substances from a cleaning surface. Recently, automatic cleaners, that is cleaners for automatically performing a cleaning operation, have begun to be more frequently utilized. The automatic cleaner suctions and removes foreign substances from a floor while being moved by the driving force of a motor powered by a battery.

A moving device is installed on a casing which defines the outer appearance of a general automatic cleaner. The moving device moves the automatic cleaner in a predetermined direction to suction foreign substances from a floor. To this end, a suction port for suctioning the foreign substances from the floor is disposed in a bottom surface of the casing. A main brush which directly contacts the foreign substances to suction the foreign substances through the suction port may be disposed on the suction port.

However, the automatic cleaner suctions only foreign substances in a region corresponding to a lower side of the casing, substantially, a region corresponding to a lower side of the suction port (e.g., under the suction port). Thus, it may be difficult to effectively clean a region outside the footprint of the suction port.

To prevent this difficulty, a side brush is disposed on the bottom surface of the casing. At any one time, at least one portion of the side brush extends outside the footprint of the casing.

The side brush is rotated with respect to the casing to move foreign substances in a region outside the footprint of the casing, specifically, outside the footprint of the suction port toward the suction port.

However, such an automatic cleaner may have following limitations.

As described above, foreign substances located in the region outside the footprint of the suction port are suctioned through the suction port by rotating the side brush. Thus, the more the side brush is increased in length, the more a cleaning area of the automatic cleaner is substantially increased. However, when the side brush is increased in length, the side brush may be damaged while cleaning or being stored. In addition, when the side brush is increased in length, a region occupied by the automatic cleaner may be increased. Thus, it may be inconvenient to store the automatic cleaner.

SUMMARY

In one embodiment, an automatic cleaner includes: a casing having a suction port in a bottom portion of the casing through which foreign substances are suctioned; a moving device that moves the casing; and a side brush assembly movably installed on the casing, wherein the side brush assembly comprises: a movable member movably disposed on the casing; a first driving device that generates power for moving the movable member; a brush rotatably mounted on the movable member; and a second driving device that generates power for rotating the brush.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

Figure 1:
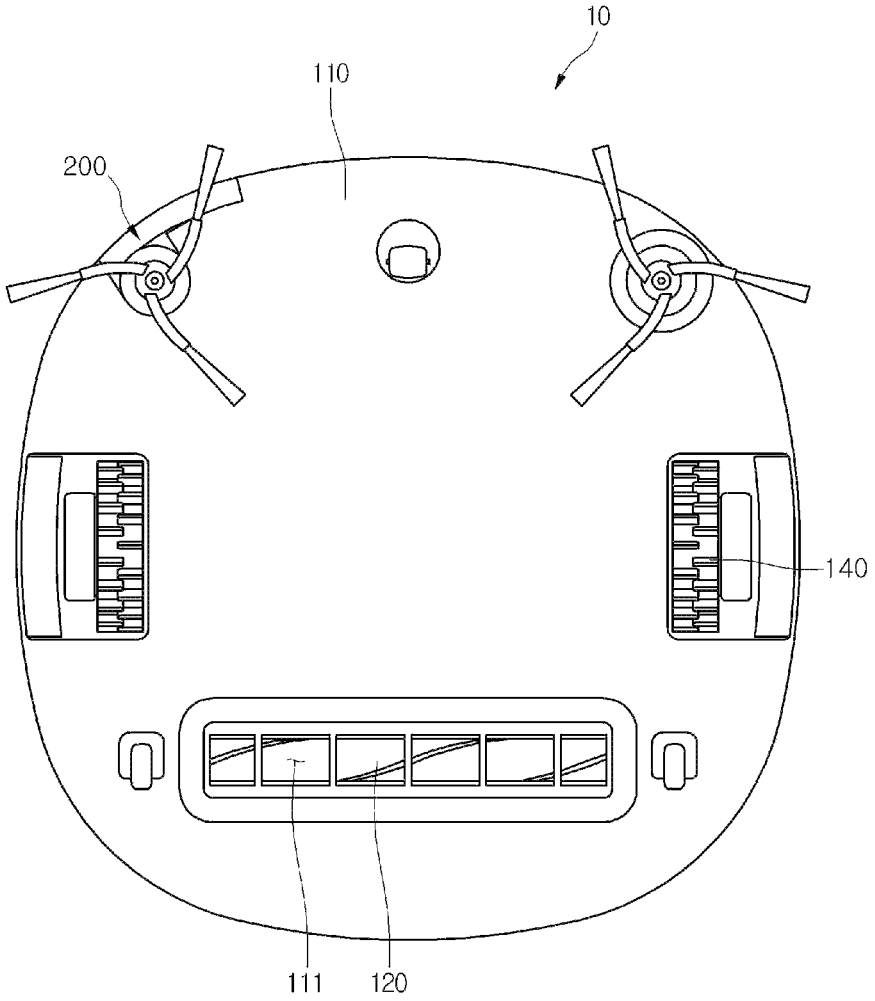
FIG. 1 is a bottom view illustrating an automatic cleaner according to a first embodiment.
Figure 2:
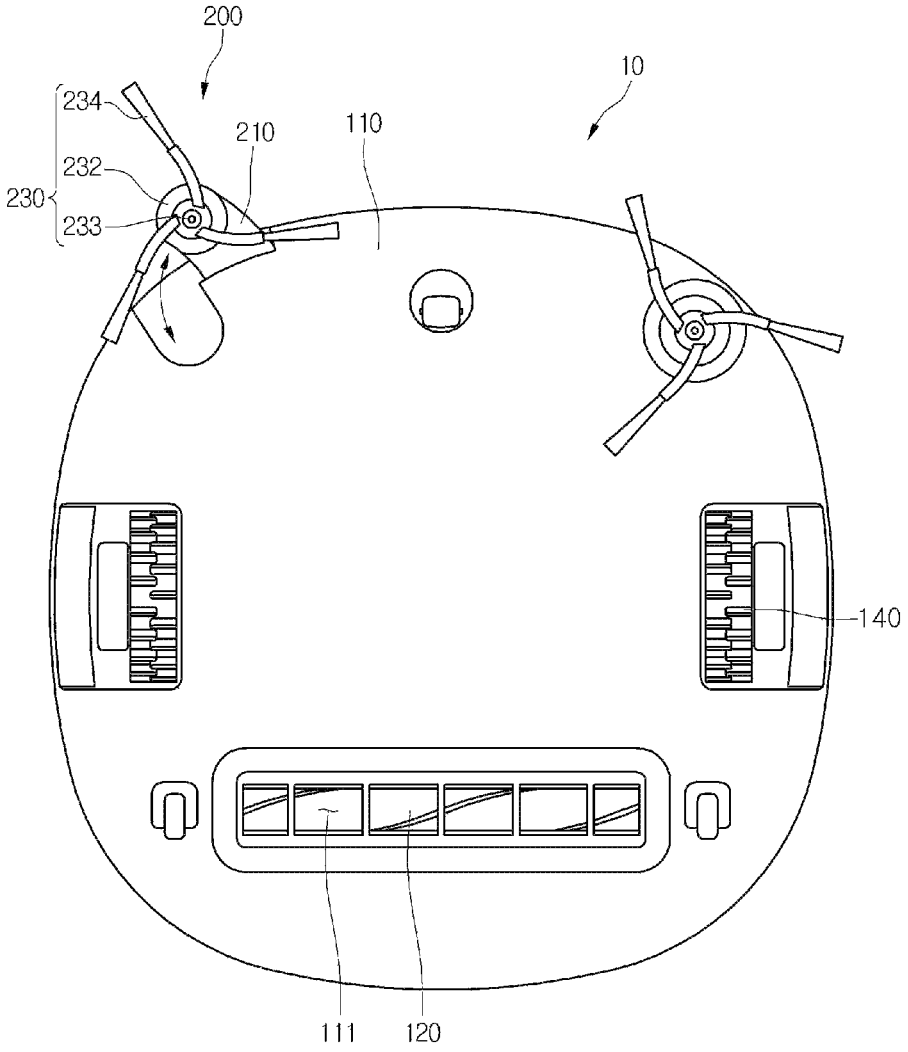
FIG. 2 is a view illustrating a state in which a side brush assembly is moved according to the first embodiment.

FIG. 1 is a bottom view of an automatic cleaner according to a first embodiment. FIG. 2 is a view illustrating a state in which a side brush assembly is moved according to the first embodiment.

Referring to FIGS. 1 and 2, an automatic cleaner 10 according to the first embodiment includes a casing 110 defining an outer appearance of automatic cleaner 10. Casing 110 may have a flat polyhedral shape, but is not limited thereto.

Various components constituting automatic cleaner 10 may be installed within casing 110. For example, a suction device (not shown) for suctioning foreign substances and a collecting device (not shown) for collecting the suctioned foreign substances may be disposed within casing 110.

A suction port 111 is defined in a bottom surface of casing 110. Suction port 111 functions as an inlet through which foreign substances are suctioned into casing 110, and in particular, into the collecting device by the suction device. Suction port 111 may be formed by partially cutting the bottom surface of casing 110.

A main brush 120 is disposed on a position corresponding to that of suction port 111 within casing 110. Main brush 120 may pass through suction port 111 to contact foreign substances on a target cleaning surface, thereby removing the foreign substances. Main brush 120 is rotatably disposed on casing 110. Also, a main driving part (not shown) providing a driving force for rotating main brush 120 is provided.

A moving device 140 for moving casing 110 may be disposed on the casing 110. Moving device 140 may include a driving motor (not shown) disposed within casing 110 and wheels rotated by the driving motor.

At least one side brush assembly 200 is disposed on a lower portion of casing 110. In the first embodiment, a structure in which a plurality of side brush assembles 200 are disposed on casing 110 will be described as an example.

Side brush assembly 200 may be movably disposed on the casing 110. For example, side brush assembly 200 may be disposed under casing 110. Particularly, at least one portion of side brush assembly 200 may be disposed within casing 110, and the other portion of side brush assembly 200 may be disposed outside casing 110. Further, side brush assembly 200 may be rotatably operated.

Side brush assembly 200 may function so that the suction device suctions foreign substances in a region outside the footprint of suction port 111.

Side brush assembly 200 may include a movable member 210 rotatably connected to casing 110 by a first rotation shaft (see FIG. 4, element 330) and a brush 230 rotatably connected to movable member 210 by a second rotation shaft 233.

A portion of movable member 210 may be disposed within the footprint of and inside of casing 110 and then protrude outside the footprint of casing 110 by the rotation of movable member 210. That is, movable member 210 may be rotated in a state where movable member 210 overlaps casing 110 as shown in FIG. 1 to protrude outside the footprint of casing 110. When movable member 210 is rotated to protrude outside the footprint of casing 110, a vertical overlapping area between movable member 210 and casing 110 may be reduced when compared to that before movable member 210 protrudes outside casing 110.

In another example, the entirety of movable member 210 may be disposed outside of but underneath casing 110. Thus, when movable member 210 is rotated, a portion of movable member 210 may protrude from a side direction of casing 110.

When movable member 210 is disposed within casing 110, brush 230 may be disposed outside casing 110 so that brush 230 is rotatable.

Brush 230 may include a brush holder 232 and a plurality of brushes 234 disposed on brush holder 232.

Figure 3:
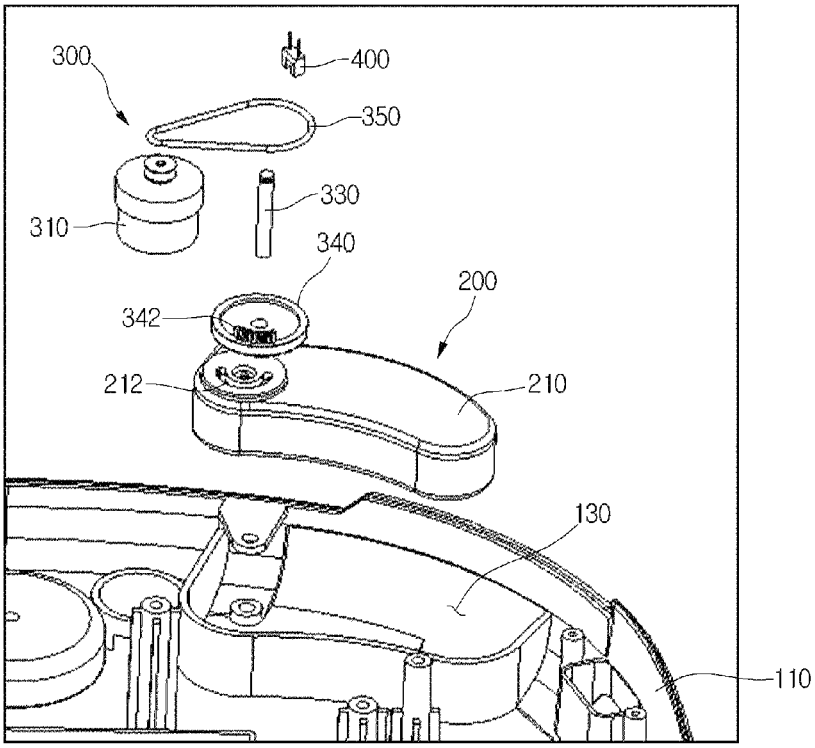
FIG. 3 is an exploded perspective view illustrating the side brush assembly and a first driving device according to the first embodiment.
Figure 4:
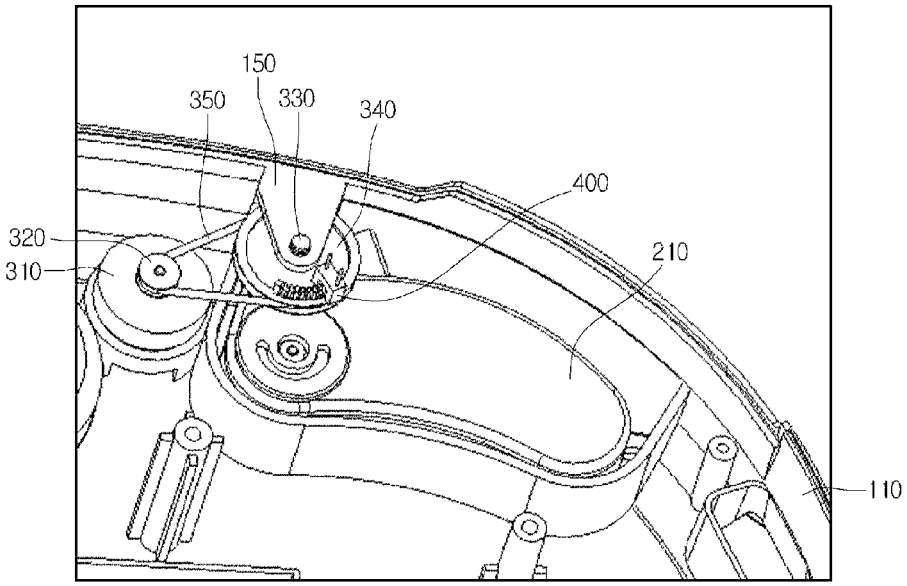
FIG. 4 is a view illustrating a state in which the side brush assembly is installed on a casing according to the first embodiment.
Figure 5:
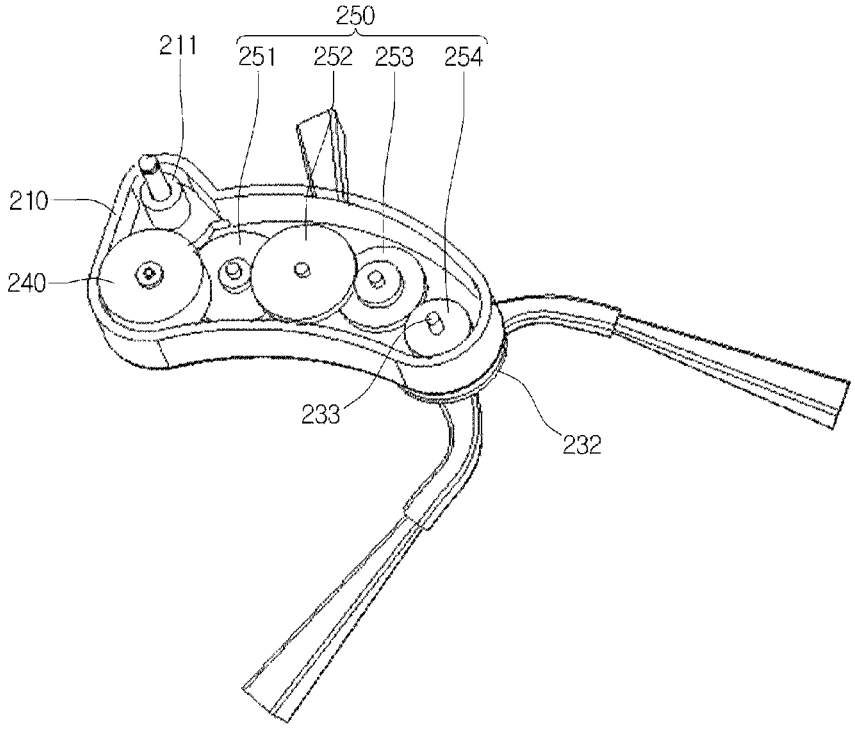
FIG. 5 is a perspective view illustrating the side brush assembly.
Figure 6:
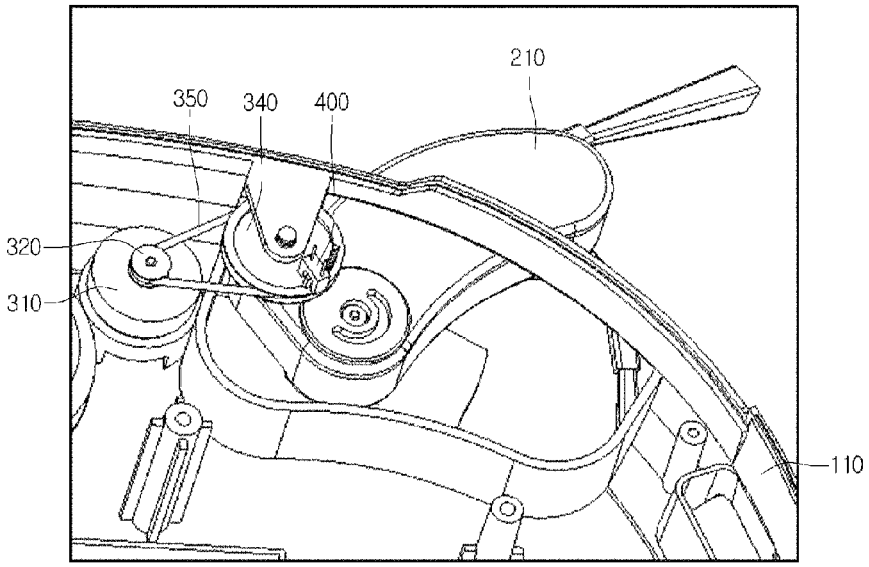
FIG. 6 is a view illustrating a state in which the side brush assembly is operated according to the first embodiment.

FIG. 3 is an exploded perspective view of the side brush assembly and a first driving device according to the first embodiment. FIG. 4 is a view illustrating a state in which the side brush assembly is installed on a casing according to the first embodiment. FIG. 5 is a perspective view of the side brush assembly. FIG. 6 is a view illustrating a state in which the side brush assembly is operated according to the first embodiment.

Referring to FIGS. 3 to 5, automatic cleaner 10 may include a first driving device 300 generating a power for rotating movable member 210.

First driving device 300 may include a first driving part 310 disposed in casing 110 and a first power transmission part for transmitting power of first driving part 310 into movable member 110. For example, first driving part 310 may be a motor rotatable in both directions or a solenoid rotatable in both directions within a predetermined angle.

The first power transmission part may function as a decelerator which decelerates a rotation rate of the motor to transmit the decelerated rotation into movable member 210.

The first power transmission part may include a first pulley 320 connected to first driving part 310, a second pulley 340 spaced apart from first pulley 320, and a belt 350 wound around first pulley 320 and second pulley 340. Second pulley 340 may have a diameter greater than that of first pulley 320. A shaft support part 150 for supporting a first rotation shaft 330 connected to second pulley 340 may be disposed on casing 110.

Although the first power transmission part includes the plurality of pulleys and the belt in the first embodiment, the disclosure is not limited thereto. For example, the first power transmission part may include a plurality of gears or a gear and link. That is, the first embodiment is not limited to the above-described structure of the first power transmission part.

A plurality of protrusions 342 are disposed on second pulley 340 and are spaced apart from each other. A rotation angle of second pulley 340 (a portion of the power transmission part) may be detected by a detection part 400. For example, detection part 400 may be a photo interrupter sensor. The first embodiment is limited to a particular kind of detection part 400. Detection part 400 may successively detect the plurality of protrusions 342 when second pulley 340 is rotated. A control part (not shown) may control first driving part 310 on the basis of information outputted from detection part 400. The control part may control first driving part 310 to restrict a rotation range of movable member 210.

That is, in the first embodiment, detection part 400 and the plurality of protrusions 342 of second pulley 340 may be referred to as a rotation range restriction part for restricting the rotation range of movable member 210.

Detection part 400 may be fixed to shaft support part 150 by an installation part (not shown) or fixed to casing 110.

First rotation shaft 330 may be disposed on a shaft fixing part 211 disposed on movable member 210. Here, first rotation shaft 330 may pass through movable member 210 and be fixed to shaft fixing part 211. First rotation shaft 330 may be rotated by the rotation of second pulley 340. Also, movable member 210 may be rotated together with first rotation shaft 330 by the rotation of first rotation shaft 330.

Side brush assembly 200 may further include a second driving device for rotating brush 230. The second driving device may include a second driving part 240 disposed on movable member 210 and a second power transmission part 250 for transmitting power of second driving part 240 into brush 230. Second power transmission part 250 may function as a decelerator which decelerates a rotation rate of second driving part 240 to transmit the decelerated rotation into brush 230.

Second power transmission part 250 may include a plurality of gears. The plurality of gears 250 may include first to fourth gears 251, 252, 253, and 254.

First gear 251 may be engaged with a motor gear (not shown). The first to third gears 251, 252, and 253 may include two gear parts having diameters different from each other. Also, one gear part having a relatively small diameter may be engaged with the adjacent other gear having a relatively large diameter. Second rotation shaft 233 connected to brush holder 232 is coupled to fourth gear 254.

A hole 212 through which an electric wire (not shown) connected to second driving part 240 passes may be defined in movable member 210. Here, since movable member 210 is rotatable, hole 212 may have an arc shape to prevent the electric wire from being damaged when movable member 210 is rotated.

Hereinafter, an operation of side brush assembly 200 will be described.

When automatic cleaner 10 is not operated, i.e., when automatic cleaner 10 is stored or charged, side brush assembly 200 is disposed at a first position. In the first embodiment, the first position of side brush assembly 200 may be a position at which movable member 210 does not protrude outside the footprint of casing 210 as shown in FIG. 1.

As described above, when side brush assembly 200 does not protrude outside the footprint of casing 110, a space required for storing automatic cleaner 10 may be reduced. Additionally, it may prevent brush 234 from being damaged when automatic cleaner 10 is stored.

When automatic cleaner 10 is turned on to perform the cleaning operation in a state of FIG. 1, an operation of the suction device starts to suction foreign substances through suction port 111. Also, moving device 140 is operated to allow the cleaner to perform the cleaning operation while the cleaner is moved.

Referring to FIGS. 2 and 5, when an operation of the suction device starts, first driving part 310 is turned on and rotated in one direction. Thus, side brush assembly 200 is moved from the first position to a second position. That is, movable member 210 is rotated to move side brush assembly 200 from the first position to the second position.

Here, the second position of side brush assembly 200 may be a position at which at least one portion of movable member 210 protrudes outside the footprint of casing 110 as shown in FIG. 2. When movable member 210 is moved from the first position to the second position, second rotation shaft 233 is moved in a horizontal direction.

While movable member 210 is rotated by first driving part 310, detection part 400 successively detects the plurality of protrusions 342. Then, when the last protrusion 342 is detected, the control part turns first driving part 310 off. That is, when detection part 400 detects the protrusion 342, a pulse may be generated. Thus, the control part determines the number of pulses to decide the on/off of first driving part 310.

Also, when the operation of the suction device starts, second driving part 240 is turned on, and thus, brush 230 is rotated. Brush 230 moves foreign substances in the region outside the footprint of suction port 111 towards a lower side of suction port 111. Then, the foreign substances moved into the lower side of suction port 111 by brush 230 are suctioned by the suction device.

Here, while or after movable member 210 is moved into the second position, when an outer force is applied to movable member 210, a slip phenomenon may occur between second pulley 340 and belt 350 to cause a relative motion between second pulley 340 and belt 350. Thus, side brush assembly 200 may absorb an outer impact to prevent movable member 210 or first driving part 310 from being damaged.

Next, when the cleaning operation of automatic cleaner 10 is stopped, operation of the suction device is likewise stopped. When automatic cleaner 10 is disposed at a predetermined position, e.g., a position at which automatic cleaner 10 is charged or stored, operation of moving device 140 is likewise stopped.

When the operation of the suction device is to be stopped, first driving part 310 is turned on and rotated in the other direction. Thus, movable member 210 is rotated to move the automatic cleaner from the second position to the first position. Detection part 400 successively detects the plurality of protrusions 342 while movable member 210 is rotated. When the last protrusion 342 is detected, the control part turns first driving part 310 off. Also, when the operation of the suction device is stopped, the rotation of second driving part 240 is stopped, and thus, the rotation of brush 230 is stopped.

Also, since movable member 210 is disposed at the first position, it may prevent side brush assembly 200, particularly, brush 230 from being exposed to the outside of automatic cleaner 10.

Although movable member 210 is stopped after movable member 210 is moved from the first position to the second position in the first embodiment, the disclosure is not limited thereto. For example, movable member 210 may be repeatedly reciprocated between the first position and the second position.

Also, although the first driving part 310 is turned on when the suction device is operated in the first embodiment, the disclosure is not limited thereto. For example, when a corner is detected, first driving part 310 may be turned on.

Particularly, after automatic cleaner 10 is turned on, automatic cleaner 10 may be automatically operated in a general mode or be operated in the general mode by inputting a start command. In the general mode of automatic cleaner 10, when automatic cleaner 10 is moved by moving device 140, the cleaning may be performed by the main brush. In some cases, second driving part 250 may be operated in the general mode to rotate brush 230 in the state where movable member 210 is stopped. Alternatively, in the general mode, the first and second driving parts may not be operated.

When automatic cleaner 10 is operated in the general mode, the control part may determine whether the corner is detected. Particularly, the control part may determine whether automatic cleaner 10 perform wall following traveling (detects a wall) or a side obstacle is detected. The wall following traveling may represent that automatic cleaner 10 is driven along a wall. Whether the wall following traveling is performed or the side obstacle is detected may be determined on the basis of information detected by an obstacle sensor (not shown).

If it is determined that automatic cleaner 10 performs the wall following traveling or the side obstacle is detected, the control part may determine whether a front obstacle (or a front wall) is detected. In general, since the corner corresponds to a portion at which a plurality of surfaces meet each other, when the wall or the side and front surfaces are detected, the control part may determine that the corner is detected.

If it is determined that the corner is detected, the control part may control automatic cleaner 10 so that automatic cleaner 10 performs a corner cleaning mode. In the corner cleaning mode, the control part may turn first driving part 310 on. When first driving part 310 is turned on, movable member 210 may be rotated from the first position to the second position. In the state where movable member 210 is rotated at a predetermined angle, first driving part 310 is turned off.

When movable member 210 is withdrawn in the corner cleaning mode, brush 230 disposed on movable member 210 may approach the corner to effectively clean the corner.

In another example, in the corner cleaning mode, movable member 210 may be repeatedly moved from the first position to the second position and from the second position to the first position. In the corner cleaning mode, moving device 140 may be maintained in a stop state.

Next, the control part may determine whether the corner is completely cleaned. For example, (1) after an operation type change time of side brush assembly 200 exceeds a reference time or an operation type of the side brush assembly is changed, (2) when the rotation number of the brush (or the second driving part) exceeds a reference number or an operation time of the second driving part exceeds a reference time, or (3) when an operation type change number exceeds a reference number, it may be determined that the corner is completely cleaned. Alternatively, whether the corner is completely cleaned may be determined by a sensor for detecting a cleaned state. For example, whether the corner is completely cleaned may be determined on the basis of a corner image photographed by a camera or may be determined on the basis of an amount of dusts suctioned through the suction port which is detected using a sensor. The present disclosure is not limited to a method for determining whether the corner is completely cleaned.

When it is determined that the corner is completely cleaned, automatic cleaner 10 may be operated again in the general mode. That is, movable member 210 is stopped at the first position.

Figure 7:
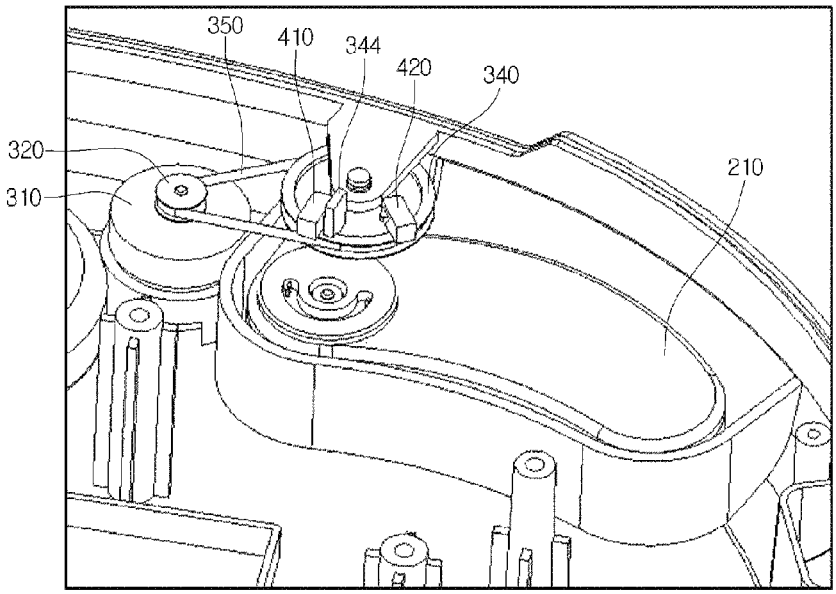
FIG. 7 is a view illustrating a state in which a side brush assembly is installed on a casing according to a second embodiment.

FIG. 7 is a view illustrating a state in which a side brush assembly is installed on a casing according to a second embodiment.

The second embodiment is equivalent to the first embodiment except for a kind of detection part. Thus, only specific portions of the second embodiment will be described below.

Referring to FIG. 7, an automatic cleaner according to the second embodiment may include a plurality of detection parts 410 and 420 for detecting a rotation angle of a second pulley 340.

The plurality of detection parts 410 and 420 may include a first detection part 410 and a second detection part 420 spaced from first detection part 410. For example, detection parts 410 and 420 may be micro switches.

A protrusion 344 may be disposed on second pulley 340. Protrusion 344 presses a contact point of first detection part 410 when second pulley 340 is rotated in one direction. On the other hand, protrusion 344 presses a contact point of second detection part 420 when second pulley 340 is rotated in the opposite direction.

When a first driving part 310 is turned on and thus rotated in one direction, a first pulley 320 and second pulley 340 are rotated in one direction. Since second pulley 340 is rotated in the one direction, a first rotation shaft 330 and a movable member 210 are rotated in one direction. When protrusion 344 presses the contact point of second detection part 420 while second pulley 340 is rotated in the one direction, a turn-on signal occurs in second detection part 420. Then, a control part receives the turn-on signal to turn first driving part 310 off.

On the other hand, when first driving part 310 is turned on to return movable member 210 to the first position, first driving part 310 is rotated in the opposite direction. When first driving part 310 is rotated in the opposite direction, first pulley 320 and second pulley 340 are rotated in the opposite direction. Also, since second pulley 340 is rotated in the opposite direction, first rotation shaft 330 and movable member 210 are rotated in the opposite direction. When protrusion 344 presses the contact point of first detection part 410 while second pulley 340 is rotated in the opposite direction, a turn-on signal occurs in first detection part 410. Then, the control part receives the turn-on signal to turn first driving part 310 off.

In the second embodiment, detection parts 410 and 420 and protrusion 344 of second pulley 340 may be referred to as a rotation range restriction part for restricting a rotation range of movable member 210.

Although protrusion(s) of the two above-described embodiments are disposed on second pulley 340, and detection parts 400, 410, and 420 detect protrusion(s) in the above-described two embodiments, the disclosure is not limited thereto. For example, the protrusion(s) may be disposed on movable member 210.

Figure 8:
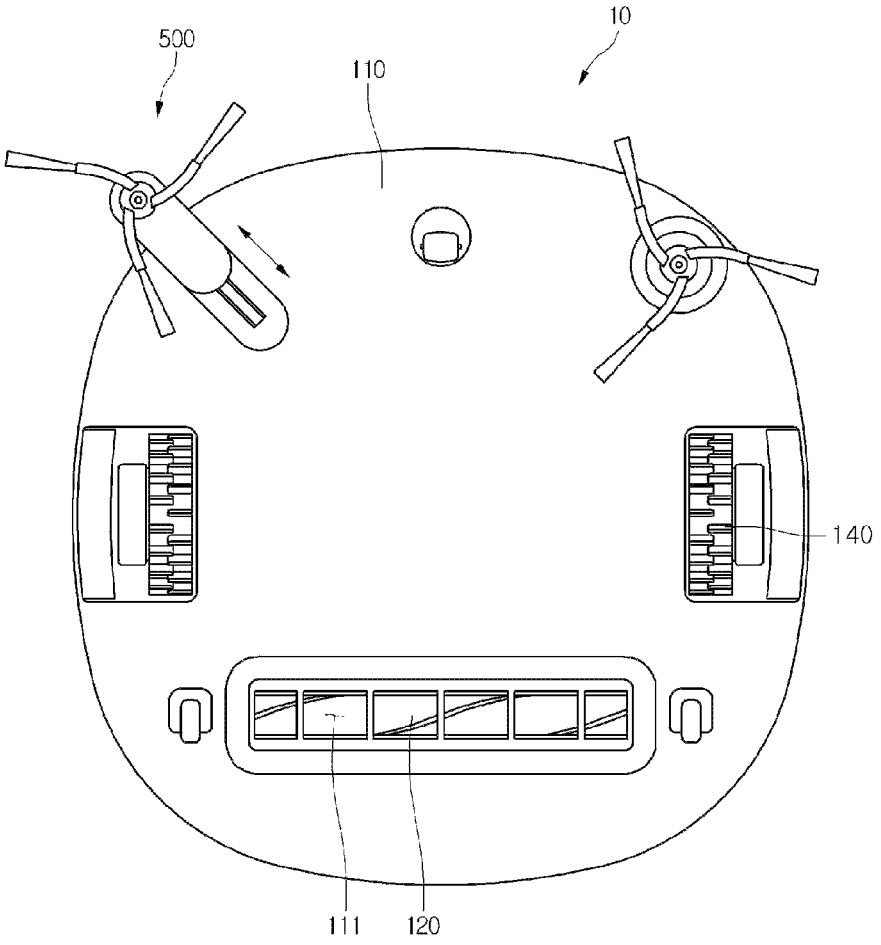
FIG. 8 is a bottom view illustrating an automatic cleaner according to a third embodiment.

FIG. 8 is a bottom view of an automatic cleaner according to a third embodiment.

The third embodiment is equivalent to the first embodiment except for an operation type of a side brush assembly. Thus, only specific portions of the current embodiment will be described below.

Referring to FIG. 8, a side brush assembly 500 according to the third embodiment, i.e., a movable member may be linearly movably disposed on a casing 110. For example, side brush assembly 500 may be linearly movably disposed on casing 110 in a diagonal direction. That is to say, the driving member may be linearly moved in a direction crossing a rotation shaft of a wheel constituting a moving device 140.

When casing 110 has a circular shape, it may be difficult to smoothly clean a portion angled at an angle of about 45° from a center of casing 110. Since a corner in a cleaning area is disposed at an angle of about 45° from the center of casing 110, the movable member may be linearly moved in a state where the movable member is inclined at an angle of about 45° with respect to a rotation shaft of the wheel constituting moving device 140 to effectively clean the corner. However, the third embodiment is not limited to an angle between a moving path of the movable member and the wheel.

Also, since other components constituting side brush assembly 500 are equal to those of the first or second embodiments, their detailed descriptions will be omitted.

According to the described embodiments, the operation type of the side brush assembly is changed during the cleaning of the corner to effectively clean the corner by the side brush assembly. Also, it may prevent the brush from being damaged, and the side brush assembly may be safely stored.

Although embodiments have been described with reference to a number of illustrative embodiments thereof, it should be understood that numerous other modifications and embodiments can be devised by those skilled in the art that will fall within the spirit and scope of the principles of this disclosure. More particularly, variations and modifications are possible in the component parts and/or arrangements of the subject combination arrangement within the scope of the disclosure, the drawings, and the appended claims. In addition to variations and modifications in the component parts and/or arrangements, alternative uses will also be apparent to those skilled in the art.

What is claimed is:

1. An automatic cleaner comprising:

a casing having a suction port in a bottom portion of the casing through which foreign substances are suctioned;

a moving device that moves the casing; and a side brush assembly movably installed on the casing, wherein the side brush assembly comprises:

a movable member movably disposed on the casing;

a first driving device that generates power to move the movable member;

a brush rotatably mounted on the movable member;

a second driving device that generates power to rotate the brush; and a rotation range restriction part that restricts a rotation range of the movable member.

2. The automatic cleaner of claim 1, wherein the first driving device comprises a first driving part and a decelerator that decelerates a rotation rate of the first driving part prior to driving the movable member.

3. The automatic cleaner of claim 2, wherein the first driving part comprises a motor rotatable in both directions or a solenoid rotatable in both directions within a predetermined range.

4. The automatic cleaner of claim 2, wherein the decelerator comprises a plurality of pulleys and a belt wound around the plurality of pulleys.

5. The automatic cleaner of claim 4, wherein the plurality of pulleys comprise:

a first pulley connected to the first driving part; and a second pulley connected to a first rotation shaft disposed on the movable member, wherein the second pulley has a diameter greater than that of the first pulley.

6. The automatic cleaner of claim 2, wherein the decelerator comprises a plurality of gears.

7. The automatic cleaner of claim 1, wherein the rotation range restriction part comprises at least one detection part that detects rotation of a portion of the power transmission part or the movable member.

8. The automatic cleaner of claim 1, wherein the movable member is stopped after the movable member is detected by the rotation range restriction part to have moved from a first position to a second position.

9. The automatic cleaner of claim 1, wherein the movable member is reciprocated between a first position and a second position based on rotation detection by the rotation range restriction part.

10. The automatic cleaner of claim 1, wherein the second driving device is disposed on the movable member and moved together with the movable member.

11. The automatic cleaner of claim 1, wherein the second driving device comprises a second driving part and a decelerator decelerating a rotating rate of the second driving part prior to driving rotation of the brush.

12. The automatic cleaner of claim 11, wherein the decelerator comprises a plurality of gears.

13. The automatic cleaner of claim 1, wherein, when the movable member is moved, a rotation shaft of the brush is moved in a horizontal direction.

14. The automatic cleaner of claim 1, wherein the movable member is received within the casing, and when the first driving part is turned on, the movable member received within the casing protrudes laterally from the casing.

15. The automatic cleaner of claim 1, wherein the movable member is disposed under the casing, and when the first driving part is turned on, the movable member disposed under the casing protrudes laterally from the casing.

16. An automatic cleaner comprising:

a casing having a suction port in a bottom portion of the casing through which foreign substances are suctioned;

a moving device that moves the casing; and a side brush assembly movably installed on the casing, wherein the side brush assembly comprises:

a movable member movably disposed on the casing;

a first driving device comprising a first driving part and a decelerator that provide power to move the movable member;

a brush rotatably mounted on the movable member; and a second driving device comprising a second driving part and a decelerator that provide power to rotate the brush, a rotation range restriction part, including at least one detection part that detects rotation of a portion of the movable member, that restricts a rotation range of the movable member, wherein the casing includes a seating recess for accommodating the movable member, wherein in a first position the movable member is accommodated in the seating recess and is fully covered by the casing, when the first driving device drives the movable member, the movable member is protruding at least partly outside the casing to a second position.

17. An automatic cleaner comprising:

a casing having a suction port in a bottom portion of the casing through which foreign substances are suctioned;

a moving device that moves the casing; and a side brush assembly movably installed on the casing, wherein the side brush assembly comprises:

a movable member movably disposed on the casing;

a first driving device that generates power to move the movable member;

a brush rotatably mounted on the movable member; and a second driving device that generates power to rotate the brush, wherein the first driving device comprises a first driving part and a decelerator that decelerates a rotation rate of the first driving part prior to driving the movable member, wherein the decelerator comprises a plurality of pulleys and a belt wound around the plurality of pulleys.

18. The automatic cleaner of claim 17, wherein the first driving part comprises a motor rotatable in both directions or a solenoid rotatable in both directions within a predetermined range.

* * * * *